United States Patent [19]

Ericsson

[11] 4,168,579

[45] Sep. 25, 1979

[54] DRYING APPARATUS INCORPORATING AN AIR-MOISTENING DEVICE

[76] Inventor: Sylve J. D. Ericsson, Storvretsvägen 48, 14700 Tumba, Sweden

[21] Appl. No.: 922,447

[22] Filed: Jul. 6, 1978

[30] Foreign Priority Application Data

Nov. 26, 1975 [SE] Sweden ..... 7613309

Related U.S. Application Data

[63] Continuation of Ser. No. 743,478, Nov. 19, 1976, abandoned.

[51] Int. Cl.[2] ..... F26B 21/08

[52] U.S. Cl. ..... 34/46; 34/50; 34/86; 34/155; 432/179

[58] Field of Search ..... 34/46, 50, 80, 86, 72, 34/155, 216, 217; 165/88, DIG. 2; 236/44 R; 432/179

[56] References Cited

U.S. PATENT DOCUMENTS

| | | | |
|---|---|---|---|
| 2,344,686 | 3/1944 | Fanselow | 34/72 |
| 3,739,482 | 6/1973 | Berg | 34/86 |
| 3,744,144 | 7/1973 | Weis | 34/50 |
| 3,793,741 | 2/1974 | Smith, Jr. | 34/155 |

*Primary Examiner*—John J. Camby
*Assistant Examiner*—Larry I. Schwartz
*Attorney, Agent, or Firm*—Burns, Doane, Swecker & Mathis

[57] ABSTRACT

There is provided a drying apparatus, which is particularly intended for drying the print on printed paper sheets for example, subsequent to said sheets leaving a printing machine. Means are provided for applying to the wet, printed surface heated air having a moisture content, which is at least substantially equal to the moisture content of the paper sheet. A heat exchanger is arranged to remove moisture from the used air exhausted from the system and to transmit this extracted moisture to fresh air drawn into the heat-exchanger for a subsequent drying operation.

8 Claims, 5 Drawing Figures

DRYING APPARATUS INCORPORATING AN AIR-MOISTENING DEVICE

This is a continuation, of application Ser. No. 743,478, filed Nov. 19, 1976 now abandoned.

FIELD OF THE PRESENT INVENTION

The present invention relates to a drying apparatus, and more particularly but not exclusively to drying apparatus for use with a printing machine for drying newly printed material, such as paper sheets, fed from the printing machine. The drying apparatus will include conveying means in the form of a carrier effective to carry said material through the machine. In addition means are provided which counteract any tendency of the material to shrink or to change its shape in any other way as a result of being dried in the drying apparatus.

BRIEF DESCRIPTION OF THE PRIOR ART

Printing machines are known to the art in which material provided with printing ink, such as newly printed sheets of paper, is dried in a drying apparatus and then cooled in a cooling section of the drying apparatus. It is also a known fact, however, that printed material treated in a drying apparatus, in which printing ink on the material is dried by subjecting said ink to streams of warm or heated air or black radiation, i.e. infra-red radiation, is also caused to change its shape as it passes into the heating section of the drying apparatus due to the exchange of moisture from said material to the air.

Subsequent to being dried in the heating section of the drying, apparatus, the printed material is passed to a cooling section of the drying apparatus in which air at ambient temperature or chilled air is blown onto the material.

Although not particularly restricted thereto, hereinafter the printed material will be referred to as a paper sheet, in order to simplify the following description of the apparatus.

It will readily be perceived that when the paper sheet, passes the heating sections of the drying apparatus, in which drying is effected by means of hot air which, as a result of it being heated, contains very little moisture, not only is the printing ink on the sheet by the hot air dried, which printing ink has a relatively high moisture content, but also the paper sheet itself, which paper sheet also has a relative high moisture content. It will thus be apparent that, during its passage through the drying apparatus, the paper sheet must lose some of its moisture content of the sheet to the air, causing the physical measurements of the sheet to change, as by shrinking for example. It is therefore desirable to ensure that, during its passage through the drying apparatus, the sheet neither transmits moisture to the air nor loses moisture thereto whilst effectively drying the printing ink. One solution in this respect would be to cause the humidity of the heating sections of the drying apparatus to be so high as to coincide or substantially coincide with the moisture content of the paper sheet, thereby preventing the transport of moisture from the sheet to the air. Another solution would be to replace moisture passing from the sheet to the air during transportation of the paper sheet through the heating sections of the drying apparatus to a subsequent cooling section. The task of supplying large quantities of moist air to the paper sheet is able to absorb the moisture which it has lost in the heating sections of the drying apparatus, has been found very difficult to realise in practice. In practice the length of a drying apparatus incorporating means for putting this latter solution into effect will be twice as long as a conventional drying apparatus in which no means for moisturing the sheet in the cooling section are provided.

The proposal to supply air to the drying apparatus of such humidity as to coincide with or substantially coincide with the moisture content of the paper sheet, thereby preventing the transport of moisture from the paper sheet to the air, has been found to present a number of problems. The moisture contained in the heated air in the drying apparatus, together with solvent absorbed by the air from printing ink, is liable to cause considerable amount of condensation in the airoutlet pipe when the air and solvent leave the drying apparatus. To solve this problem, it would be necessary to heat the air-outlet pipe, as a whole, to a temperature equal to or only just below the temperature of the drying apparatus.

It has been assumed that the use of moist air in the drying apparatus will provide a poorer drying effect that would dry air. This assumption is not particularly well founded, especially in view of the fact that moist air has a higher transition number than dry air, hence the drying ability of moist air and of dry air would be practically the same. The primary reason why moist air has not previously been used in the heating section of a drying apparatus, is because moist air has a much higher heat content than dry air and if air exhibiting a high heat content is permitted to pass freely to the ambient air, the amount of energy consumed in such a drying apparatus would be considerable.

It will thus readily be perceived that a solution proposing the use of moist air in the heating sections of such a drying apparatus would be encumbered with difficult problems.

It is previously known to use in a drying apparatus, and particularly in drying apparatus intended for printing machines, such as silk-screen printing machines, a heat exchanger, to reduce the amount of energy consumed in the drying apparatus.

OBJECTS OT THE PRESENT INVENTION

Present day highly developed printing machines, which may operate at very high printing speeds, require progressively more effective drying apparatus. Since the air used for drying purpose absorbs therein gases given off by the print etc. on the sheets as they are dryed, the air cannot be re-used in the drying apparatus, but must be removed therefrom.

In order to conserve energy in the drying apparatus, it is necessary for the energy content of air used for a drying operation to be transferred to the air intended for a further drying operation. By such transfer of the energy or heat content of the air, air which is intended for a subsequent drying operation can be pre-heated, thereby effectively reducing the amount of energy which need be supplied to the drying apparatus.

When the heating section or sections of a drying apparatus are to use moist drying air, it is therefore necessary to transfer as large part as possible of the energy content of the used air to fresh air intended for a subsequent drying operation. Primarily this means that the moisture in the air which has been used for a preceding drying operation shall be transferred to air intended for a subsequent drying operation.

An object of the present invention is to provide a drying apparatus which fulfills the aforementioned desiderata.

Accordingly, this invention consists in a drying apparatus particularly intended for drying a printed material fed from a printing machine, preferably a paper sheet, including a conveying means in the form of a carrier effective to carry said material through said machine, and having means for counteracting any tendancy of the material to shrink or change its shape as a result of being dried by the drying apparatus, in which the air used in the drying apparatus is given, via means arranged therefore, a relative moisture constant which is so adapted to or substantially so adapted to the moisture content of the material that said material, during the drying process, is not subjected to shrinkage or change in shape, or is only subjected to such shrinkage or change in shape to a slight degree.

BRIEF DESCRIPTION OF THE DRAWINGS

So that the invention will be more readily understood and further features thereof made apparent, an embodiment of the invention will now be described with reference to the accompanying schematic drawings in which FIG. 2 is a horizontal sectional view of a first part of the heating section of a drying apparatus according to FIG. 1, while

DESCRIPTION OF THE PREFERRED EMBODIMENT

Figure 1:
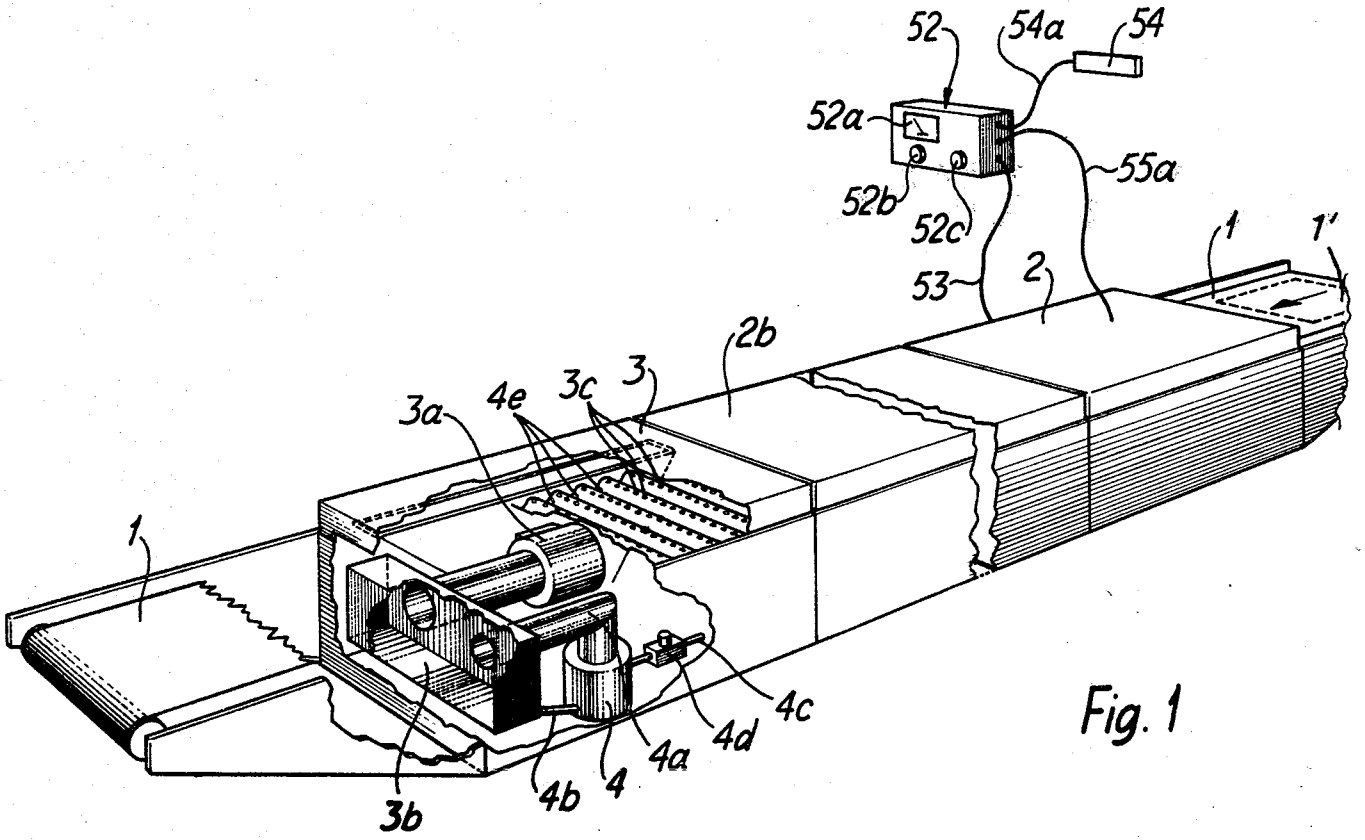
FIG. 1 is a partly sectional view in perspective of a drying apparatus comprising a heating section and a cooling section and a conveyor belt extending between said sections.

In FIG. 1 of the accompanying drawings there is thus shown an arrangement which, in accordance with the invention, is intended to counteract changes in shape, such as shrinkage, of a papersheet provided with printing ink, during the passage of said papersheet through a drying apparatus, said papersheet being conveyed from a printing machine (not shown) to a conveying means 1 extending through the entire drying apparatus. The drying apparatus shown in FIG. 1 exhibits a multiplicity of drying sections or heating sections 2 and a terminal cooling section 3. Subsequent to being printed in the printing machine, the paper sheet 1′ is conveyed to the conveying means 1 and is passed through the heating sections 2, in which the sheet 1′ is exposed to a stream of hot, moist air.

The construction of the heating sections 2 will be described in more detail hereinafter.

Subsequent to passing the heating sections, the paper sheet 1′ is passed to the cooling section 3, in which the sheet is exposed to a stream of cold air delivered by a fan 3*a* arranged in said cooling section 3. The fan 3*a* is arranged to draw air from an inlet 3*b* and to force the air through a multiplicity of air channels 3*c*. Holes 3*c* are shown to be above the belt 1 in FIG. 1. When these air channels 3*c* are arranged beneath the conveyer belt 1 as is the case of the FIG. 1 embodiment it is convenient to provide the conveyor belt 1 with air holes or for the conveyor belt to have the form of an air-permeable cloth. There is nothing to prevent, however, the stream of air from being directed onto the upper surface of the paper sheet from above.

In certain instances it may be suitable for the cooling section 3 to cooperate with a single moistening system, so that the air leaving the cooling section obtains a relative humidity which is slightly higher than the relative humidity of the ambient air. Such a mositening system is referenced in FIG. 1. The moistening system 4 is arranged to communicate with the inlet 3*b* of the cooling section through a pipe 4*a*. The inlet 3*b* has the form of a box and is connected, by means of drainage pipe 4*b*, with the moistening system 4. Water is supplied to the moistening system 4 through a pipe 4*c* and the supply of water is controlled by a magnet valve 4*d* associated with said pipe 4*c*.

Conveniently, the paper sheet is so turned that the moist, cooling air is applied to the plain side of said sheet i.e. the side thereof which has not been printed upon in a immediate preceding printing operation.

Figure 2:
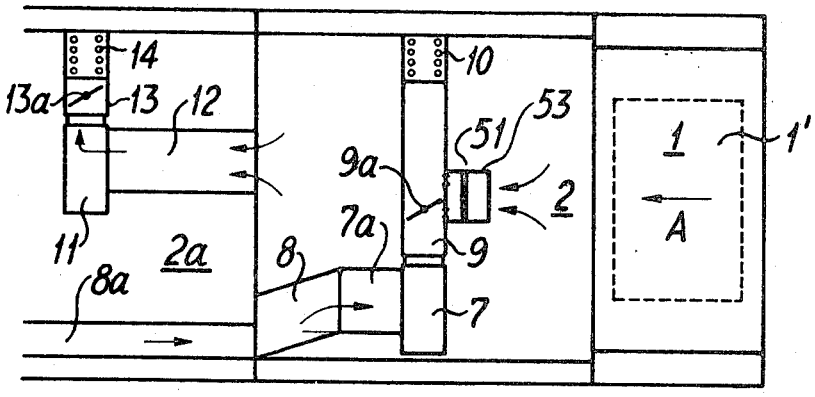

FIG. 2 shows the heating sections of the drying apparatus according to FIG. 1, in which a coating, such as printing ink, on a printed paper sheet is to be dried. As previously mentioned, the printing machine may have the form of a silk-screen printing machine so arranged that the printed sheet of material is fed directly from the machine onto the conveyor belt 1 and thence into the heating sections 2. The printed paper sheet 1′ is inserted into the heating section in the direction shown by the arrow A in the drawing.

Subsequent to the paper sheet passing onto the conveyor means 1 it is conveyed into the section 2.

In the illustrated embodiment, the heating section comprises there part section 2, 2*a* and 2*b*, although the number of part-sections used may be more or less than three. Subsequent to passing through the part-section 2, 2*a* and 2*b* the paper sheet is passed to the cooling sections 3. The sheet 1′ is then conveyed by the conveyor belt 1 to a depositing device shown to the left in FIG. 1. The depositing device does not form part of the present invention and has consequently not been shown in detail in the drawing.

The heating section of the drying apparatus is arranged to dry the printing on a paper sheet with hot air (having a temperature of 50°–80° C.). To this end, the section 2 is provided with a fan 7, the input side 7*a* of which communicates with a fresh-air inlet opening 8*d* via passages 8, 8*a*, 8*b* and 8*c*.

An air-moistening unit is incorporated in a passage 9, the construction of said unit being described in more detail hereinafter.

Figure 3:
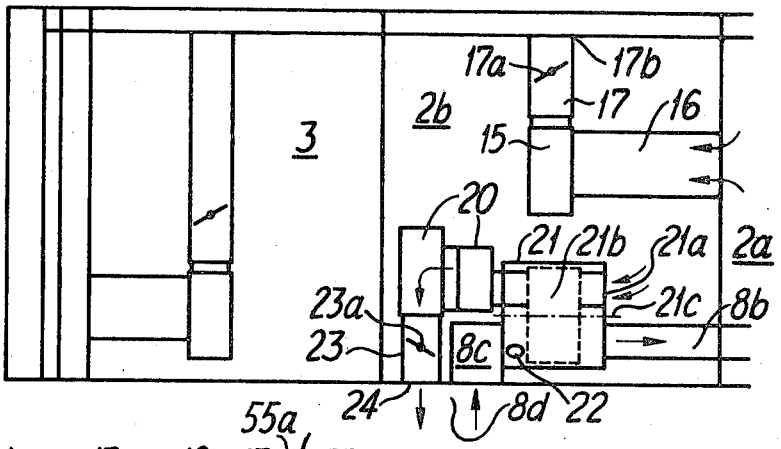
FIG. 3 is a horizontal sectional view of a second part of the heating section of a drying apparatus according to FIG. 1.
Figure 4:
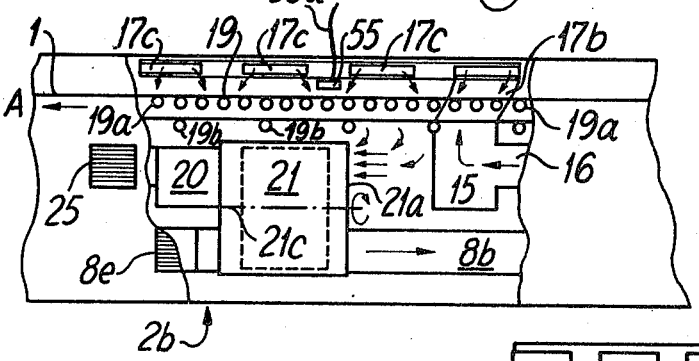
FIG. 4 is a side view in section of the principle construction of the heating section of a drying apparatus utilizing a heat exchanger.

The opening 8*d* is provided with a grid-like structure and a filter or the like. The fan 7 is arranged to pump fresh air through the passage 9, which is provided with a regulating valve, such as the butterfly valve 9*a* shown in the Figure. Conveniently, the passage 9 may be provided with a heating elements 10. In the exemplaray embodiement it is assumed that the heating elements are electrically operated (the input power may be of the order of magnitude of 30 kW). Subsequent to the air being heated by elements 10 (which are normally located beneath the conveying belt 1), air is fed from the fan 7 to nozzles placed above the conveyor belt and directed towards the paper sheet thereon and towards that part of the paper sheet which has been printed upon. The air, thus heated, is permitted to pass through the conveyor belt and, by means of a fan 11 located in partsection 2*a*, is drawn into the section 2 through a passage 12, the air drawn into the section 2 through a passage 12, the air being fed through a passage 13 provided with a valve 13*a* to further heating devices 14. These heating devices 14 are also electrically operated. (They may have a power corresponding approximately to 5 kW). This heated air is also passed to above the conveyor belt and blown down against the printed sheet. As shown in FIG. 3, the heated air in the partsection 2*a* passes through the conveyor belt and is drawn, by a fan 15, through a passage 16 from where it is fed through a further passage 17, having a valve 17*a* arranged therein, through a still further passage 17*b* to the upper side of the part of the conveyor belt, referenced 19 in FIG. 4. The part section 2*b* is shown partly in section and in simplified construction in FIG. 4. The passage 17*b* branches into a multiplicity of ejection nozzles 17*c*. The conveyor belt 1, or that part thereof referenced 19 in FIG. 4, is carried by a multiplicity of rollers 19*a* which move in the direction shown by the arrow in FIG. 4. All heating sections 2, 2*a*, 2*b* of the illustrated embodiment are identical in construction.

By means of a fan 20 place in partsection 2*b* air used in a drying operation is drawn through an inlet opening 21*a* into a heat exchanger 21. The heat exchanger 21 comprises a rotatable drum 21*b* mounted for rotation on a shaft 21*c*. The drum exhibits a multiplicity of heatabsorbing grid-like structures or cells and air used in a previous drying operation passes to the heat exchanger from right to left as seen in FIG. 4. The drum 21*b* is rotated by a motor 22 as air used in a preceding drying operation is passed to the heat-absorbing gridlike structures. The air used for drying the print on a sheet of material in section 2*b* is drawn by the fan 20 through the heat exchanger 21 and passes, via a passage 23 and a valve 23*a*, out through an opening 24, which may be provided with a grid-like structure 25 and a particle-separating filter device.

As previously mentioned, the air intended for a subsequent drying operating shall be allowed to pass through the heat exchanger 21, this being effected through passages 8*c* and 8*b*. Fresh air is introduced through grid-like structure 8*e* and is heated in the heat exchanger 21, the pre-heated air being passed through passages 8*b*, 8*a* to the fan 7. In this way the input energy of heating means 10 can be reduced, as can also the input energy of heating means 14.

It should be observed that when passing through the heat exchanger 21 the air used in a preceding drying operation and air intended for a subsequent drying operation shall pass through the heat exhanger on respective sides of the shaft 21*c*. It should also be observed that used air present in the heat exchanger cells must first be removed from the grid-like structure or cells of the heat exchanger before this part of the heat exchanger contacted by said used air is exposed to the air intended for a subsequent drying operation, thereby to prevent exhaust gases extracted by the used air from the printing ink, for example, entering the fresh air. The used air can be removed by arranging that the absorbing grid-like structures is free before they are transferred to emit heat to the air intended for a subsequent drying operation.

That zone of the heat exchanger which is free between the used air outlet and the fresh air inlet is also designated the purifying zone, said purifying zone being located immediately above the shaft 21*c*, as shown in FIG. 3.

In accordance with the invention, the heat exchanger is provided with a water or moisture absorbing material, the used air transferring moisture and heat to the heat exchanger whilst the fresh air takes up moisture and heat therefrom.

Since the heat exchanger has the form of a rotatable drum provided with heat-absorbing portions, for example in the form of cells of grid-like structure, the moisture or water-absorbing material can be arranged between the grids. The water-absorbing material may conveniently comprise paper, such as blotting paper.

Arranged in the passage 9 is an air-moistening unit 51. The unit 51 is arranged to impart to the moist air used in the heating section of the drying apparatus a relative humidity which is so adjusted to or substantially so adjusted to the moisture content of the sheet that the sheet during the drying process in the heating sections 2–2*b* will not absorb or lose moisture, or will only give off moiusture and lose moisture to a very slight extent. To this end, the invention includes a moisture-regulating device 52 which is connected to an air-moistening unit incorporated in the drying apparatus via a connecting line 53. The moisture-regulating device 52 is arranged to bring into operation different sections of the air-moistening device 51 in dependence upon the relative humidity of the air surrounding the drying apparatus, which is measured by a sensing device 54 connected to the moisture-regulating device via a line 54*a*, which the relative humidity in the drying apparatus is measured by a sensing device 55 connected to the moisture-regulating device 52 via a line 55*a*.

The moisture-regulating device is arranged to operate in conjunction with a indicator 52*a*, from which the relationship between the relative humidities evaluated by the sensing device 54 and the sensing device 55 can be read off. By means of a setting device 52*b* and 52*c* respectively it is possible to regulate the relationship between the relative humidites to a predetermined value. Conveniently the moisture-regulating device 52 may be arrange to maintain the relative humidity in the heating section of the drying apparatus via the sensing device 55 at the same or substantially the same level as the realtive humidity of the ambient air via the sensing device 54.

Figure 5:
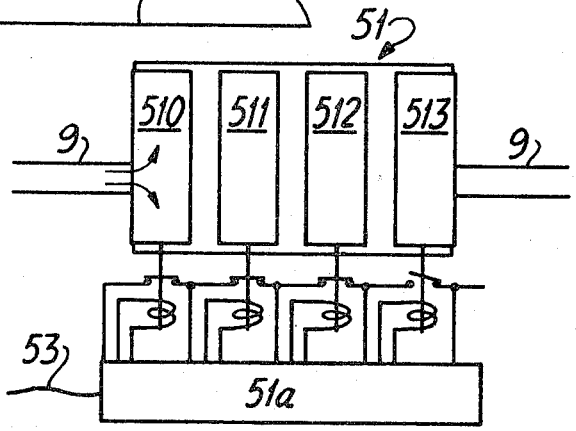
FIG. 5 shows the principle construction of a unit with moist air.

The moisture-regulating device 52 is arranged to control the air-moistening unit 51 via a line 53. The line 53 passes to an electronic apparatus 51*a* which is constructed in a manner known per se such that, in response to a signal on the conductor 53, it energises one or more of the sections of the air-moistenting device, said sections being designated 510–513. The air-moistening device 51 may conveniently be constructed to provide an air-humidity of one and the same relative value through passage 8*a* irrespective of the humidity of the air entering through passage 8*b*. This is effected by causing different sections to be made operative. FIG. 5 showns how sections 510, 511 and 512 are operative while the section 513 is inoperative. This means that when the moisture-regulating device 52 requires a higher relative humidity in the heating section 2, a further section 513 of the air-moistening unit is made operative, while, on the other hand, when the moisture-regulating device 52 requires a lower humidity in the heating section 2, a section, such as section 512, of the air moistening unit 51 is made inoperative.

The invention is naturally not restricted to the aforedescribed embodiments but can be modified within the scope of the accompanying claims.

What is claimed is:

1. A drying apparatus for drying the print on a printed material, after it is fed from a printing machine, and maintaining the moisture content of said material substantially constant during said drying process comprising:

conveying means for carrying said material through said drying apparatus;

at least one drying section arranged along said conveying means and including;

means for drawing a flow of air into said drying section;

means for exhausting said air such that the exhausted air is not substantially intermixed with the incoming air;

means for maintaining a relative moisture content for said flow adapted to the moisture content of said material so that during the drying the moisture content of said material is maintained substantially constant so as to substantially avoid shrinkage;

means for adjusting the relative moisture to a predetermined value which substantially corresponds to the moisture content in said material; and further means in said drying section for transferring heat and moisture in the outgoing air to the incoming air.

2. A drying apparatus for drying the print on a printed material, after it is fed from a printing machine, and maintaining the moisture content of said material substantially constant during said drying process comprising:

conveying means for carrying said material through said drying apparatus;

at least one drying section arranged along said conveying means and including;

means for drawing a flow of air into said drying section;

means for maintaining a relative moisture content for said new flow adapted to the moisture content of said material so that during the drying the moisture content of said material is maintained substantially constant so as to substantially avoid shrinkage;

means for adjusting the relative moisture to a predetermined value which substantially corresponds to the moisture content in said material;

means for transferring heat and moisture in the outgoing air to the incoming air; and a heat exchanger arranged in the drying apparatus, said heat exchanger being provided with a moisture-absorbing material, whereby the air used in a drying operation gives off moisture and heat while air intended for a subsequent drying operation takes up moisture and heat.

3. A drying apparatus according to claim 2 further including means for controlling the moisture content in said flow of air to a predetermined value, and wherein said moisture-controlling means is arranged to make operative different sections of the air-moistening means in dependence upon the relative humidity of the air surrounding the drying apparatus and the relative humidity of the drying apparatus, in particular the relative humidity of the drying section of the apparatus.

4. A drying apparatus according to claim 2 further including means for controlling the moisture content in said flow of air to a predetermined value; and wherein said moisture-regulating means is arranged to maintain the relative humidity in the drying apparatus at substantially the same level as the ambient air.

5. A drying apparatus according to claim 2 wherein said heat exchanger comprises a rotatable drum having heat absorbing portions, and wherein the air used in a drying operation and the air intended for a subsequent drying operation is arranged to pass through the heat exchanger on respective sides of the rotation shaft of said heat exchanger.

6. A drying apparatus according to claim 5 wherein said heat absorbing portions are in the form of grids.

7. A drying apparatus according to claim 5, wherein the used air present in the heat exchanger is removed therefrom prior to that part being exposed to the air intended for a subsequent drying operation.

8. A drying apparatus for drying the print on a printed material after it is fed from a printing machine while maintaining the moisture content of said material substantially constant comprising:

conveying means for carrying said material through said drying apparatus;

at least one drying section arranged along said conveying means and including;

means for drawing a flow of air into said drying section;

means for maintaining a relative moisture content for said flow adapted to the moisture content of said material so that during the drying process the moisture content of said material is maintained substantially constant so as to substantially avoid shrinkage;

means for heating said flow to a predetermined temperature;

means for directing a flow of heated, moist air against said material to dry said print;

means for adjusting the relative moisture to a predetermined value, which substantially corresponds to the moisture content in said material;

succeeding drying sections arranged along said conveying means and including means in said succeeding sections for drawing the flow of heated, moist air from said preceding drying section into said succeeding drying section;

means in said succeeding drying sections for further regulating and heating said flow and for directing said flow against said material as it advances through the drying apparatus;

heat exchanger means in the last drying section of said succeeding drying sections for transferring a quantity of the heat from the flow of air exhausting from said last drying section to said incoming flow;

a cooling section downstream of said last drying section for providing a stream of cold air including;

means for drawing ambient air into said cooling section; and means for directing said cold air against said material for cooling said sheet as it advances along said conveying means from said drying apparatus.

* * * * *